US006520156B2

(12) United States Patent
Kojima

(10) Patent No.: US 6,520,156 B2
(45) Date of Patent: Feb. 18, 2003

(54) HIGH-PRESSURE FUEL SUPPLY SYSTEM

(75) Inventor: Susumu Kojima, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/943,156

(22) Filed: Aug. 31, 2001

(65) Prior Publication Data

US 2002/0029761 A1 Mar. 14, 2002

(30) Foreign Application Priority Data

Sep. 11, 2000 (JP) ..... 2000-275502

(51) Int. Cl.[7] ..... F02M 37/04
(52) U.S. Cl. ..... 123/456; 123/179.17
(58) Field of Search ..... 123/179.17, 447, 123/456, 557, 198 D

(56) References Cited

U.S. PATENT DOCUMENTS 2,986,881 A * 6/1961 Moore ..... 123/447
3,827,409 A * 8/1974 O'Neill ..... 123/458
4,200,079 A * 4/1980 Darlington ..... 123/179.16
4,591,321 A * 5/1986 Devaux ..... 417/499
5,711,275 A * 1/1998 Minagawa et al. ..... 123/458
5,839,413 A * 11/1998 Krause et al. ..... 123/447
6,053,712 A * 4/2000 Konishi et al. ..... 123/446
6,325,048 B1 * 12/2001 Robinson ..... 123/463

FOREIGN PATENT DOCUMENTS

| | | |
|---|---|---|
| JP | U 5-1854 | 1/1993 |
| JP | A 05-001646 | 1/1993 |
| JP | A 05-39883 | 2/1993 |
| JP | A 09-184464 | 7/1997 |

* cited by examiner

*Primary Examiner*—Carl S. Miller
(74) *Attorney, Agent, or Firm*—Oliff & Berridge, PLC.

(57) ABSTRACT

A high-pressure fuel supply system includes an accumulator-type booster mechanism which increases the pressure in a high-pressure portion of the high-pressure fuel supply system to a preset starting pressure upon starting of an engine. The accumulator-type booster mechanism is supported on the engine body.

12 Claims, 2 Drawing Sheets

HIGH-PRESSURE FUEL SUPPLY SYSTEM

INCORPORATION BY REFERENCE

The disclosure of Japanese Patent Application No. 2000-275502 filed on Sep. 11, 2000 including the specification, drawings and abstract is incorporated herein by reference in its entirety.

BACKGROUND OF THE INVENTION

1. Field of Invention

The invention relates to a high-pressure fuel supply system for performing fuel injection to an internal combustion engine.

2. Description of Related Art

In order to perform fuel injection directly into cylinders of an internal combustion engine, it is required to supply a highly pressurized fuel or high-pressure fuel to each of fuel injection valves. A high-pressure fuel supply system employed for the aforementioned purpose is well known in the art.

A general high-pressure fuel supply system includes a delivery pipe leading to each of the fuel injection valves, a high-pressure pump for feeding the high-pressure fuel under pressure to the delivery pipe, and a low-pressure pump connected to an intake side of the high-pressure pump so as to make sure that the fuel is admitted by the high-pressure pump. Generally the low-pressure pump is of an electric power driven type, and therefore is capable of feeding the fuel under pressure at a rated discharge pressure immediately after the engine start-up. On the other hand, as the high-pressure pump is of an engine-driven type, it is not sufficiently driven immediately after the engine start-up, thus failing to feed sufficient amount of the fuel under pressure.

There have been proposed various kinds of technique to initiate fuel injection by increasing the pressure in the delivery pipe to the rated discharge pressure of the low-pressure pump (e.g., 0.3 MPa) upon the engine start-up. However, the rated discharge pressure is considerably lower than a target high fuel pressure (e.g., 12 MPa) of the delivery pipe in a normal condition. Therefore, it is difficult to initiate the fuel injection at an appropriate pressure in the delivery pipe.

In order to solve the aforementioned problem, JP-A-9-184464 discloses an accumulator type boosting mechanism. In this boosting mechanism, an accumulator that accumulates the fuel pressure during an engine operation is employed so as to increase the pressure in a high-pressure pipe to a preset starting pressure upon the engine start-up.

SUMMARY OF THE INVENTION

It is an object of the invention to provide a high-pressure fuel supply system for fuel injection of an internal combustion engine including an accumulator-type boosting mechanism with an improved structure.

A high-pressure fuel supply system is provided with an accumulator type boosting mechanism which raises a pressure of a high-pressure portion of the high-pressure fuel supply system to a predetermined starting pressure upon starting up of an internal combustion engine. The accumulator type boosting mechanism is supported on the internal combustion engine.

In the high-pressure fuel supply system, the high-pressure portion is provided with a delivery pipe which supplies a high-pressure fuel to a plurality of fuel injection valves, and the delivery pipe is supported on the plurality of fuel injection valves mounted in the internal combustion engine. The accumulator type boosting mechanism is connected to the delivery pipe at a portion near a fuel inlet.

In the high-pressure fuel supply system, the accumulator type boosting mechanism includes a gas chamber and a liquid chamber interposed between the gas chamber and a fuel in the high-pressure portion, and the gas chamber and the liquid chamber are separated by an elastically deformable diaphragm.

In the high-pressure fuel supply system, the accumulator type boosting mechanism includes a gas chamber, a fuel chamber, a communication path that allows communication between the fuel chamber and the high-pressure portion, a valve body which serves to open and close the communication path, and a solenoid which operates the valve body. The solenoid is disposed in the fuel chamber, which is utilized to raise a fuel temperature in the fuel chamber.

DETAILED DESCRIPTION OF PREFERRED EMBODIMENTS

Figure 1:
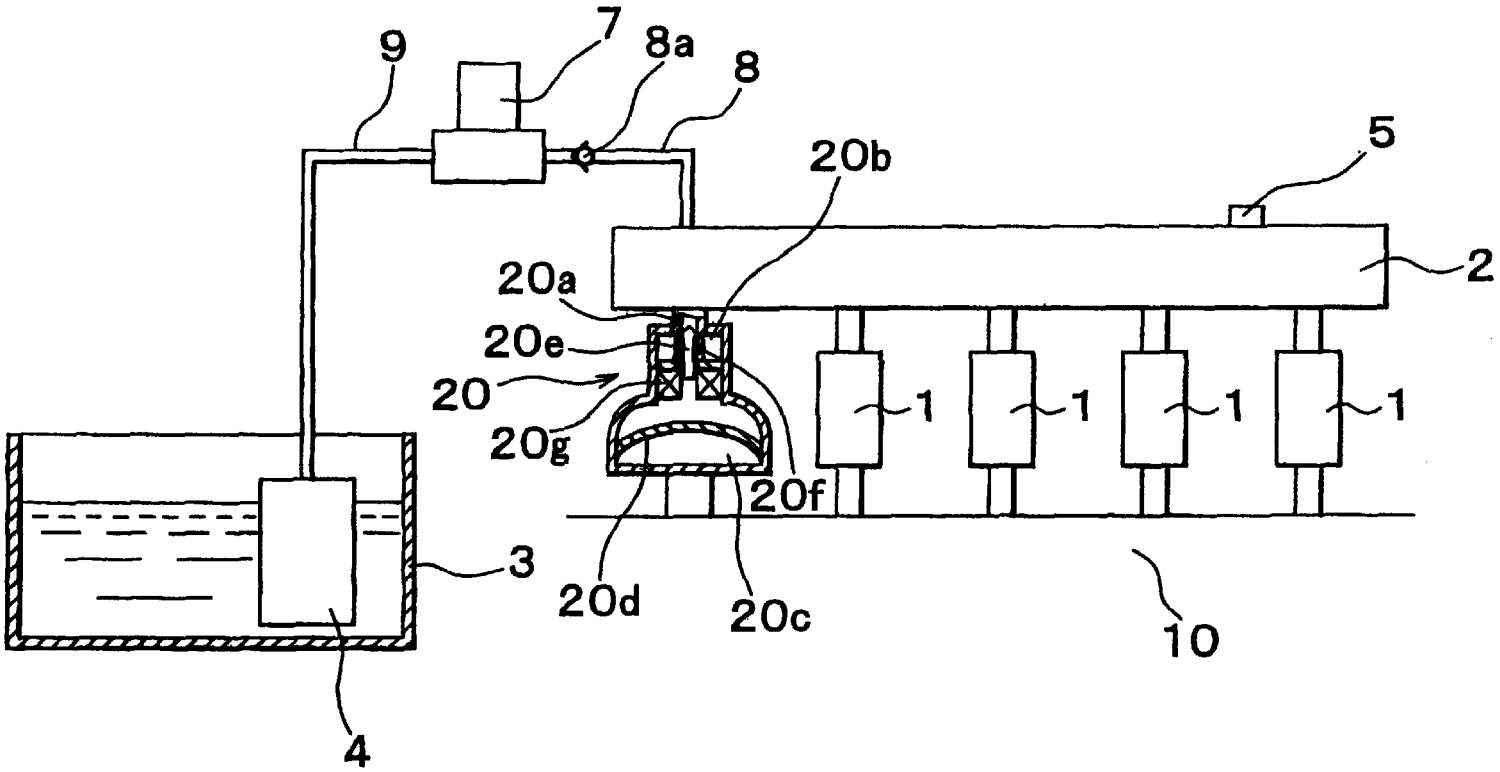
FIG. 1 is a view schematically showing a first embodiment of a high-pressure fuel supply system for performing fuel injection to an internal combustion engine, which is provided with an accumulator-type boosting mechanism according to the invention.

FIG. 1 is a view schematically showing a first embodiment of a high-pressure fuel supply system for performing fuel injection to an internal combustion engine according to the invention. The embodiment will be explained in regard to a four-cylinder engine. However, this is not intended to limit the invention. Referring to FIG. 1, four fuel injection valves 1 are provided for the respective cylinders. A delivery pipe 2 supplies the high-pressure fuel to each of the fuel injection valves 1. Each fuel injection valve 1 is mounted to an engine body 10 and the delivery pipe 2 so as to serve as a support member that supports the delivery pipe 2 on the engine body 10. The delivery pipe 2 is provided with a pressure sensor 5 for detecting a fuel pressure in the delivery pipe 2. Each fuel injection valve 1 has a valve body for opening and closing an injection nozzle, and a solenoid for pulling the valve body toward the valve-opening direction (both of which are not shown). The spring force and the fuel pressure in the delivery pipe 2 are exerted to the valve body in the valve-opening direction. When the solenoid is in a demagnetized state, the valve can be reliably closed such that fuel injection is discontinued. When the solenoid is in a magnetized state, it pulls the valve body in the valve-opening direction against the spring force and the fuel pressure such that the fuel injection is performed.

A low-pressure pump 4 is disposed in a fuel tank 3. The low-pressure pump 4 is an electric pump driven by a battery. The low-pressure pump 4 has a rated discharge pressure of, for example, 0.3 MPa. The low-pressure pump 4 is actuated in response to an ON signal of a starter switch. A filter (not shown) for removing foreign matter from the fuel admitted from the fuel tank 3 is provided at the intake side of the low-pressure pump 4.

A high-pressure pump 7 maintains the fuel pressure in the delivery pipe 2 around a target high fuel pressure of, for example, 12 MPa. The high-pressure pump 7 is an engine-driven pump having a plunger driven by a cam coupled to a crankshaft to feed the fuel under pressure. In this embodiment, the discharge stroke of the high-pressure pump 7 is conducted at every fuel injection performed by two cylinders.

A discharge side of the high-pressure pump 7 is connected to the delivery pipe 2 through a high-pressure pipe 8, and the intake side of the high-pressure pump 7 is connected to the discharge side of the low-pressure pump 4 through a low-pressure pipe 9. As described above, the fuel admitted from the low-pressure pipe 9 in the intake stroke of the high-pressure pump 7 has been pressurized to 0.3 MPa by the low-pressure pump 4. Therefore, generation of fuel vapor due to a negative pressure is less likely to occur in the low-pressure pipe 9. A check valve 8*a* that opens at a preset pressure is disposed in the high-pressure pipe 8 so as to prevent the backflow of the fuel due to pressure pulsation caused by the high-pressure pump 7. A portion downstream of the high-pressure pump 7 (downstream of the check valve 8*a* when the check valve 8*a* is disposed at the discharge side of the high-pressure pump 7) including the delivery pipe 2 serves as a high-pressure portion of the high-pressure fuel supply system.

The high-pressure pump 7 adjusts the flow rate of the fuel such that the fuel pressure in the delivery pipe 2 is raised to the target high fuel pressure. An excess amount of the fuel discharged from the plunger is returned to the fuel tank 3 through the low-pressure pipe 9. It is not preferable to allow the high-pressure fuel to flow reversely in the low-pressure pump 4. Therefore, the low-pressure pipe 9 may be communicated with the fuel tank 3 through a safety valve that opens at a pressure that slightly exceeds the rated discharge pressure of the low-pressure pump 4. In order to prevent abnormal increase in the fuel pressure in the delivery pipe 2 for a certain reason, the delivery pipe 2 may be communicated with the fuel tank 3 through a return pipe having a safety valve that opens at a fuel pressure slightly exceeding the target high fuel pressure.

If the aforementioned return pipe is provided, the high-pressure pump 7 is allowed to feed the whole volume of the fuel under pressure discharged from the plunger to the delivery pipe 2 without adjusting the flow rate of the fuel.

In any case, provided that the high-pressure pump 7 is actuated in an appropriate condition after starting the engine, the pressure in the delivery pipe 2 can be maintained around the target high fuel pressure, whereby fuel injection is initiated in good condition with the fuel injection valves 1. However, since the high-pressure pump 7 is driven by the engine, it is difficult to realize appropriate actuation of the high-pressure pump 7 at a low engine speed by a starter motor. Therefore, although the fuel pressure in the delivery pipe 2 reduced approximately to the atmospheric pressure has to be rapidly increased upon start-up of the engine, such sharp increase in the fuel pressure cannot be realized.

On the other hand, the electric low-pressure pump 4 can be actuated appropriately even upon the engine start-up. Accordingly, the fuel can be fed under pressure at the rated discharge pressure. It is therefore possible to raise the pressure in the delivery pipe 2 to the rated discharge pressure of the low-pressure pump 4. As described above, however, the rated discharge pressure of the low-pressure pump 4 is considerably lower than the target high fuel pressure. Therefore, it is difficult to perform fuel injection in a desired spray form. Moreover, the time taken for keeping the fuel injection valve 1 opened for injecting the required amount of the fuel is further elongated. It is, thus, difficult to perform fuel injection at a desired timing.

The high-pressure fuel supply system of this embodiment includes a booster mechanism 20 of accumulator type which is operable to raise the fuel pressure in the delivery pipe 2 to become higher than the rated discharge pressure of the low-pressure pump 4 upon the engine start-up. More specifically, the booster mechanism includes a communication path 20*a*, a fuel chamber 20*b* connected to the delivery pipe through the communication path 20*a* and communicated therewith, and a gas chamber 20*c* sealed with a gas such as nitrogen at a predetermined pressure equal to or higher than the atmospheric pressure. A diaphragm 20*d* formed from an elastically deformable material such as a rubber separates the fuel chamber 20*b* and the gas chamber 20*c*.

The fuel chamber 20*b* accommodates a valve body 20*e* capable of opening and closing the communication path 20*a*, a spring 20*f* for biasing the valve body 20*e* to the valve-closing direction, and a solenoid 20*g* for opening the valve body 20*e* against the biasing force of the spring 20*f*.

In the above-structured booster mechanism 20, when the fuel pressure in the delivery pipe 2 is raised to a high pressure during the engine operation, the valve body 20*e* easily opens because of relatively small biasing force of the spring 20*f* such that the communication path 20*a* is opened. Accordingly, the pressure in the fuel chamber 20*b* becomes equal to the pressure in the delivery pipe 2. This pressure acts on the diaphragm 20*d*, compressing nitrogen in the gas chamber 20*c* to the same pressure to accumulate the pressure. Slight decrease in the pressure of the delivery pipe 2 may close the valve body 20*e*. In this way, the pressure of the gas chamber 20*c* is kept in the vicinity of the target high fuel pressure in the delivery pipe 2 during the engine operation.

Upon start-up of the engine, the solenoid 20*g* is magnetized to open the valve body 20*e* and thus the communication path 20*a*. As a result, the gas chamber 20*c* releases the accumulated pressure. The pressure in the gas chamber 20*c* is exerted to the fuel in the delivery pipe 2 through the fuel in the fuel pipe 20*b*. Accordingly, the fuel pressure in the delivery pipe 2 can be raised to a preset starting pressure that is higher than the discharge pressure of the low-pressure pump 4. Thus, appropriate fuel injection can be realized upon start-up of the engine, ensuring reliable start-up of the engine.

In the aforementioned booster mechanism 20, each pressure of the fuel and gas in the fuel chamber 20*b* and the gas chamber 20*c* is required to be kept in the vicinity of the target high fuel pressure of the delivery pipe 2. This may require a rigid housing, making the booster mechanism 20 heavy. In the case where the valve body 20*e* and the solenoid 20*g* are disposed in the fuel chamber 20*b* as in the present embodiment, the booster mechanism 20 becomes even heavier. When the aforementioned heavy booster mechanism 20 is mounted to the high-pressure fuel supply system in a cantilever state, sufficient mounting strength is required to cope with vibration of the vehicle and the like. This may increase the costs and size of the system.

In order to prevent the increase in the costs and the size, the accumulator-type booster mechanism 20 of this embodiment is supported on the engine body 10. This structure is effective to reduce the vibration of the booster mechanism 20 of its own against the high-pressure portion of the high-pressure fuel supply system. In particular, the booster mechanism 20 of this embodiment is connected to the delivery pipe 2 in the high-pressure portion of the high-pressure fuel supply system, and the delivery pipe 2 is supported on the engine body 10 by the fuel injection valves 1. Therefore, the booster mechanism 20 vibrates together with the delivery pipe 2, so that a large bending stress is not generated in the mounting portion of the booster mechanism 20 to the delivery pipe 2 like in the communication path 20*a* of this embodiment. Accordingly, sufficient durability can be obtained without considerably increasing the mounting strength.

In this embodiment, the accumulator-type booster mechanism 20 is connected to the delivery pipe 2 at a position near the fuel inlet thereof, i.e., near the joint portion to the high-pressure pipe 8 extending from the high-pressure pump 7. During the engine operation, the fuel continuously flows into the delivery pipe 2 from the fuel tank 3, whereby the delivery pipe 2 has a relatively lower temperature at a position near the fuel inlet compared with the temperature at the other position. Therefore, by connecting the accumulator-type booster mechanism 20 near the fuel inlet of the delivery pipe 2, temperature rise in the booster mechanism 20 can be minimized. When the difference in temperature of the gas chamber between during the engine operation and engine start-up is reduced, the difference in gas temperature in the gas chamber between during pressure accumulation and during pressure discharge is reduced. Therefore, the pressure accumulated during the engine operation can be discharged upon start-up of the engine without considerable reduction therein.

If the fuel is expanded by raising the fuel temperature in the fuel chamber 20*b* upon the engine start-up, the fuel pressure in the fuel chamber 20*b* and the gas pressure in the gas chamber 20*c* are both increased. This makes it possible to increase the fuel pressure in the delivery pipe 2 to an even higher pressure upon opening of the valve body 20*e*, ensuring further reliable engine start-up. In this embodiment, the components required for the accumulator-type booster mechanism, i.e., the valve body 20*e* and the solenoid 20*g* for opening the same, are disposed in the fuel chamber 20*b*. By applying an alternating voltage to the solenoid 20*g* prior to opening of the valve body 20*e*, the solenoid 20*e* generates the heat, whereby the fuel temperature in the fuel chamber 20*b* can be increased. This enables the pressure in the gas chamber 20*c* to be increased without providing any special heating device.

In the accumulator-type booster mechanism 20 of this embodiment, the diaphragm 20*d* separates the fuel chamber 20*b* and the gas chamber 20*c* from each other. However, a piston that is slidable without elastic deformation may be used instead of the diaphragm.

Figure 2:
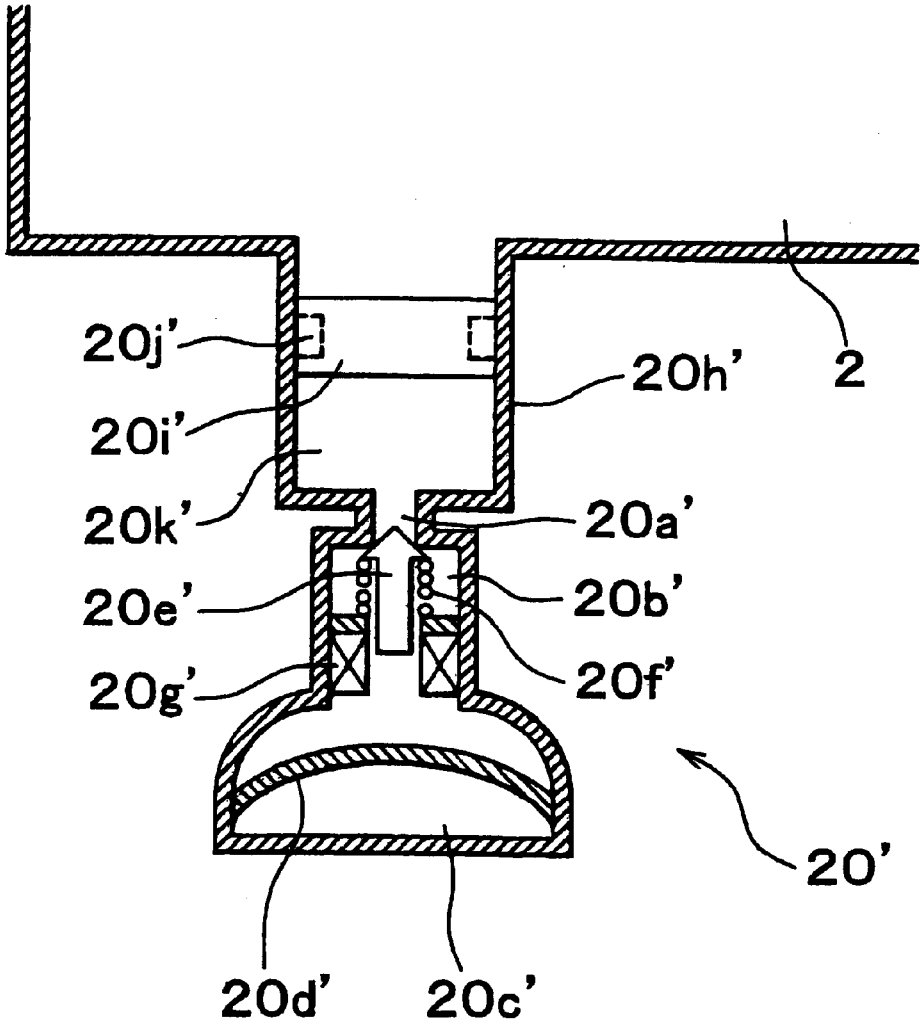
FIG. 2 is a view schematically showing another type of the accumulator-type boosting mechanism that can be incorporated into the high-pressure fuel supply system in place of the one shown in FIG. 1.

FIG. 2 is a schematic diagram showing another accumulator-type booster mechanism that can be used in the high-pressure fuel supply system for performing fuel injection to the internal combustion engine according to the invention. Hereinafter, only the differences from the aforementioned accumulator-type booster mechanism 20 will be described. The same or corresponding components as those of the aforementioned accumulator-type booster mechanism 20 are denoted with the same reference numerals and characters. The accumulator-type booster mechanism 20' is connected to the delivery pipe 2 through a cylinder portion 20*h*'. A space 20*b*' communicating with the cylinder portion 20*h*' through a communication path 20*a*' is not a fuel chamber but a liquid chamber containing liquid such as hydraulic fluid. The cylinder portion 20*h*' is also a liquid chamber, and a piston 20*i*' separates the fuel in the delivery pipe 2 from the hydraulic fluid. The piston 20*i*' is slidable within the cylinder portion 20*h*'. A seal member 20*j*' is provided around the piston 20*i*' in order to ensure separation between the fuel and the hydraulic fluid even during sliding.

In the accumulator-type booster mechanism 20' having the aforementioned structure, a gas chamber 20*c*' accumulates and discharges a pressure through the hydraulic oil in the liquid chambers 20*b*' and 20*h*'. Therefore, the accumulator-type booster mechanism 20' is capable of functioning in the same manner as that of the aforementioned accumulator-type booster mechanism 20. Moreover, in this accumulator-type booster mechanism 20', a diaphragm 20*d*' formed from a material such as rubber is not in contact with the fuel. Therefore, by selecting a material that does not affect the rubber like silicone oil as the hydraulic oil, the life of the diaphragm can be significantly elongated. This accumulator-type booster mechanism 20' includes the piston 20*i*' in order to separate the hydraulic fluid in the cylinder portion 20*h*' from the fuel in the delivery pipe 2. However, the piston 20*h*' may be omitted by, e.g., replacing the hydraulic fluid with a fluid that is less likely to be dissolved in and mixed with the fuel, such as mercury.

During operation of the engine, a large amount of fuel is injected particularly when the engine is in a high-load state. At this time, the high-pressure pump also discharges a large amount of fuel to the delivery pipe 2 of the high-pressure fuel supply system. Such flow of a large amount of fuel to and from the delivery pipe 2 causes relatively large variation in the fuel pressure therein. Such large variation in pressure hinders accurate control of the fuel injection amount with the valve-opening time. In the case where the accumulator 20, 20' as a booster mechanism is connected to the delivery pipe 2 like in this embodiment, opening the valve body 20*e*, 20*e*' enables the variation in pressure to be reduced by causing a change in volume of the gas chamber 20*c*, 20*c*' of the accumulator.

The fuel pressure in the delivery pipe 2 of the high-pressure fuel supply system is not always maintained around the same target fuel pressure during operation of the engine. The target fuel pressure may be changed according to the fuel injection amount. For example, when only a small fuel injection amount is required like during the engine idling, the opening time of the fuel injection valve is minimized. However, a high pressure in the delivery pipe would cause an excessive amount of the fuel to be injected, degrading the fuel consumption rate. It is therefore preferable that the target high fuel pressure of the delivery pipe is reduced during the engine idling.

It is now assumed that two target fuel pressures, i.e., higher and lower target fuel pressures, are selectively used as a fuel pressure in the delivery pipe. In this case, provided that the accumulator is connected to the delivery pipe as in this embodiment, the valve body 20*e*, 20*e*' is closed with the spring 20*f*, 20*f*' when the lower target fuel pressure is intended, whereas the valve body 20*e*, 20*e*' is opened with magnetization of the solenoid 20*g*, 20*g*' when the higher target fuel pressure is intended. Thus, when the lower target fuel pressure is intended, the valve body 20*e*, 20*e*' is closed, whereby the previous higher target fuel pressure is accumulated in the accumulator 20, 20'. In order to realize the lower target fuel pressure, feeding of the fuel under pressure from the high-pressure pump 7 is discontinued and fuel injection is conducted. As a result of closing the valve body 20*e*, 20*e*', the volume of the fuel chamber 20*b* or the portion 20*b*' of the fuel chamber of the accumulator 20, 20' is removed from the volume of the high-pressure portion of the high-pressure fuel supply system, enabling rapid reduction in pressure.

In order to realize the higher target fuel pressure, fuel discharged from the high-pressure pump 7 is maximized.

Moreover, since the valve body 20*e*, 20*e*' is opened, the pressure accumulated in the accumulator can be utilized, enabling rapid pressure increase.

The high-pressure fuel supply system of this embodiment has the delivery pipe 2 as a high-pressure portion. However, the idea regarding the structure of the aforementioned accumulator-type booster mechanism is also applicable to a high-pressure fuel supply system without delivery pipe such as a general diesel engine.

The high-pressure fuel supply system of the invention includes an accumulator-type booster mechanism for increasing the pressure in the high-pressure portion of the high-pressure fuel supply system to a preset starting pressure upon start-up of the engine, and the accumulator-type booster mechanism is supported on the engine body. This reduces independent vibration of the accumulator-type booster mechanism against the high-pressure portion. Accordingly, sufficient durability of the mounting portion of the accumulator-type booster mechanism to the high-pressure fuel supply system is ensured without considerably increasing the mounting strength.

Another high-pressure fuel supply system according to the invention includes an accumulator-type booster mechanism for increasing the pressure in the high-pressure portion of the high-pressure fuel supply system to a preset starting pressure upon the engine start-up. The accumulator-type booster mechanism has a gas chamber and a liquid chamber located between the gas chamber and the fuel in the high-pressure portion. An elastically deformable diaphragm separates the gas chamber from the liquid chamber. Therefore, the diaphragm is not brought into contact with the fuel, extending the life of the diaphragm.

Still another high-pressure fuel supply system according to the invention includes an accumulator-type booster mechanism for increasing the pressure in the high-pressure portion of the high-pressure fuel supply system to a preset starting pressure upon starting of the engine. The accumulator-type booster mechanism has a gas chamber, a fuel chamber, a communication path allowing for communication between the fuel chamber and the high-pressure portion, a valve body capable of opening and closing the communication path, and a solenoid for actuating the valve body. The solenoid is disposed in the fuel chamber, so that the solenoid for actuating the valve body required for the accumulator-type booster mechanism is also utilized to heat the fuel in the fuel chamber. This enables thermal expansion of the fuel in the fuel chamber as well as further increase in pressure in the fuel chamber and the gas chamber without providing any special heating means. Accordingly, the high-pressure portion has a further increased fuel pressure upon starting of the engine, whereby more excellent starting of the engine can be ensured.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A high-pressure fuel supply system, comprising:

an accumulator type boosting mechanism which raises a pressure of a high-pressure portion of the high-pressure fuel supply system to a predetermined starting pressure upon starting up of an internal combustion engine, the accumulator type boosting mechanism supported on the internal combustion engine, the accumulator type boosting mechanism comprising:

a gas chamber;

a liquid chamber interposed between the gas chamber and a fuel in the high-pressure portion, the liquid chamber containing a hydraulic fluid; and an elastically deformable diaphragm that separates the gas chamber from the liquid chamber.

2. The high-pressure fuel supply system according to claim 1, wherein the liquid chamber contains a fluid which is insoluble in the fuel.

3. The high-pressure fuel supply system according to claim 1, wherein the liquid chamber and the high-pressure portion are separated by a piston that is capable of sliding between the liquid chamber and the high-pressure portion.

4. A high-pressure fuel supply system, comprising an accumulator type boosting mechanism which raises a pressure of a high-pressure portion of the high-pressure fuel supply system to a predetermined starting pressure upon starting up of an internal combustion engine, the accumulator type boosting mechanism supported on the internal combustion engine, the accumulator type boosting mechanism comprising:

a gas chamber;

a fuel chamber;

a communication path that allows communication between the fuel chamber and the high-pressure portion;

a valve body which serves to open and close the communication path; and a solenoid which operates the valve body, the solenoid being disposed in the fuel chamber, which is utilized to raise a fuel temperature in the fuel chamber.

5. The high-pressure fuel supply system according to claim 4, wherein the fuel chamber and the gas chamber are separated by an elastically deformable diaphragm.

6. The high-pressure fuel supply system according to claim 4, wherein the fuel chamber and the gas chamber are separated by a piston that is capable of sliding between the fuel chamber and the gas chamber.

7. A high-pressure fuel supply system, comprising:

an accumulator type boosting mechanism which raises a pressure of the high-pressure portion of the high-pressure fuel supply system to a predetermined starting pressure upon starting up of the internal combustion engine, the accumulator type boosting mechanism comprising:

a gas chamber;

a liquid chamber interposed between the gas chamber and a fuel in the high-pressure portion, the liquid chamber containing a work fluid; and an elastically deformable diaphragm that separates the gas chamber from the liquid chamber.

8. The high-pressure fuel supply system according to claim 7, wherein the liquid chamber contains a fluid insoluble in the fuel.

9. The high-pressure fuel supply system according to claim 7, wherein the liquid chamber and the high-pressure portion are separated by a piston that is capable of sliding between the liquid chamber and the high-pressure portion.

10. A high-pressure fuel supply system, comprising an accumulator type boosting mechanism which raises a pressure of the high-pressure portion of the high-pressure fuel supply system to a predetermined starting pressure upon starting up of the internal combustion engine, wherein:

the accumulator type boosting mechanism includes a gas chamber, a fuel chamber, a communication path that allows communication between the fuel chamber and the high-pressure portion, a valve body which serves to open and close the communication path, and a solenoid which actuates the valve body; and the solenoid is disposed in the fuel chamber, and is utilized to raise a fuel temperature in the fuel chamber.

11. The high-pressure fuel supply system according to claim 10, wherein the fuel chamber and the gas chamber are separated by an elastically deformable diaphragm.

12. The high-pressure fuel supply system according to claim 10, wherein the fuel chamber and the gas chamber are separated by a piston slidable between the fuel chamber and the gas chamber.

* * * * *